US008907804B2

(12) United States Patent
Wan

(10) Patent No.: US 8,907,804 B2
(45) Date of Patent: Dec. 9, 2014

(54) ALTERNATING CURRENT CONTACTOR WITH ELECTRONIC SHORT CIRCUIT SELF-LOCKING FUNCTION

(75) Inventor: Jiasheng Wan, Wuhan (CN)

(73) Assignee: Hubei Shengjia Wiring Co., Ltd., Wuhan, Hubei Province (CN)

( * ) Notice: Subject to any disclaimer, the term of this patent is extended or adjusted under 35 U.S.C. 154(b) by 167 days.

(21) Appl. No.: 13/578,393

(22) PCT Filed: Jun. 11, 2010

(86) PCT No.: PCT/CN2010/000828

§ 371 (c)(1),
(2), (4) Date: Aug. 10, 2012

(87) PCT Pub. No.: WO2011/097774

PCT Pub. Date: Aug. 18, 2011

(65) Prior Publication Data

US 2012/0313788 A1 Dec. 13, 2012

(30) Foreign Application Priority Data

Feb. 10, 2010 (CN) ..... 2010 1 01281574

(51) Int. Cl.
*G08B 21/00* (2006.01)

(52) U.S. Cl.
USPC ..... 340/650; 340/635; 340/638; 340/657

(58) Field of Classification Search
USPC ..... 340/635, 638, 650, 657; 335/6, 8, 25, 335/131, 132, 167, 168; 361/607, 608, 617
See application file for complete search history.

(56) References Cited

U.S. PATENT DOCUMENTS 5,508,670 A * 4/1996 Mantzouridis et al. ..... 335/172
5,546,062 A * 8/1996 Duchemin ..... 335/132

FOREIGN PATENT DOCUMENTS

CN 101620957 A * 1/2010

* cited by examiner

*Primary Examiner* — Hung T. Nguyen

(57) ABSTRACT

An alternating current contactor (AC contactor) with an electronic short circuit self-locking function, includes an AC contactor body (a). The AC contactor body (a) includes a shell body. A short circuit self-locking portion is provided inside the shell body. The short circuit self-locking portion includes a current collecting unit (b) for collecting a current signal of phase lines (A, B, C); a short circuit detecting unit (c) for obtaining a voltage signal which characterizes a current signal, comparing with a reference signal, and outputting a short circuit detecting signal when short circuit occurs; a short circuit self-locking executing unit (d) for obtaining the short circuit detecting signal to trigger the AC contactor body (a) to generate and maintain a circuit-breaking action; and a self-locking releasing unit (e) for releasing self-locking of the AC contactor body (a) and resetting the alternating current contactor body (a).

16 Claims, 5 Drawing Sheets

ALTERNATING CURRENT CONTACTOR WITH ELECTRONIC SHORT CIRCUIT SELF-LOCKING FUNCTION

CROSS REFERENCE OF RELATED APPLICATION

This is a U.S. National Stage under 35 USC 371 of the International Application PCT/CN2010/000828, filed on Jun. 11, 2010

BACKGROUND OF THE PRESENT INVENTION

1. Field of Invention

The present invention relates to an alternating current contactor (AC contactor) having a protective function, and more particularly to an AC contactor with an electronic short circuit self-locking function.

2. Description of Related Arts

It is well known that AC contactors are widely adopted in currently existing control equipments for switching on/off or controlling of power lines. Usually a main contact is adopted to open or close a circuit, an auxiliary contact is adopted to execute a control instruction. The main contact is ordinarily a normally open contact. The auxiliary contacts ordinarily comprise a pair of normally open contacts and a pair of normally closed contacts. Cooperated with a main circuit, a small-scale contactor is often adopted as an intermediate relay.

The contacts of the AC contactors are made of silver alloy, and have good conductivity and high-temperature ablation resistance.

In this application, a structure that is capable of achieve basic functions of an AC contactor in conventional techniques is called an AC contactor body.

In actual processes, the AC contactor mentioned above is capable of breaking a circuit under instructions of a control equipment while working. If a thermal relay is not capable of operating a protection action timely when short circuit occurs, a contactor is not capable of breaking timely, or if an electronic protective equipment does not have a self-locking protection function in a short circuit fault, the AC contactor body usually executes instructions of the control equipment to attach up, which leads to damage of equipments or a fire disaster. In addition, a short circuit accident occurs on the AC contactor body, and circuit breaking action is generated. Technicians of the related arts only see the result of the circuit breaking, but are not capable of knowing causes of the circuit breaking, which confuses maintenance staffs as well.

In view of the defects mentioned above, inventors finally obtained the present invention after a long period of research and practice.

SUMMARY OF THE PRESENT INVENTION

An object of the present invention is to provide an AC contactor with electronic short circuit self-locking function, so as to overcome the defects mentioned above.

Accordingly, in order to accomplish the above objects, technical solution adopted by the present invention is to provide an AC contactor with electronic short circuit self-locking function, which comprises an AC contactor body, wherein the AC contactor body comprises a shell body, and a short circuit self-locking portion is provided inside the shell body, wherein the short circuit self-locking portion comprises:

a current collecting unit for collecting current signals of phase lines;

a short circuit detecting unit for obtaining a voltage signal which characterizes the current signals, comparing with a reference signal, and outputting a short circuit detecting signal when short circuit occurs;

a short circuit self-locking executing unit for obtaining the short circuit detecting signal to trigger the AC contactor body to generate and maintain a circuit-breaking action; and a self-locking releasing unit for releasing self-locking of the AC contactor body and resetting the AC contactor body.

Compared with the prior art, beneficial effects of the present invention lie in that the AC contactor with electronic short circuit self-locking function according to a preferred embodiment of the present invention is capable of generating a self-locking action, and thus can only be unlocked in a manual way, so as to realize an ultimate object of electrical safety. Simultaneously, the AC contactor of the present invention has a function of indicating a short circuit fault.

DETAILED DESCRIPTION OF THE PREFERRED EMBODIMENT

These and other objectives, features, and advantages of the present invention will become apparent from the following detailed description, the accompanying drawings, and the appended claims.

Figure 1:
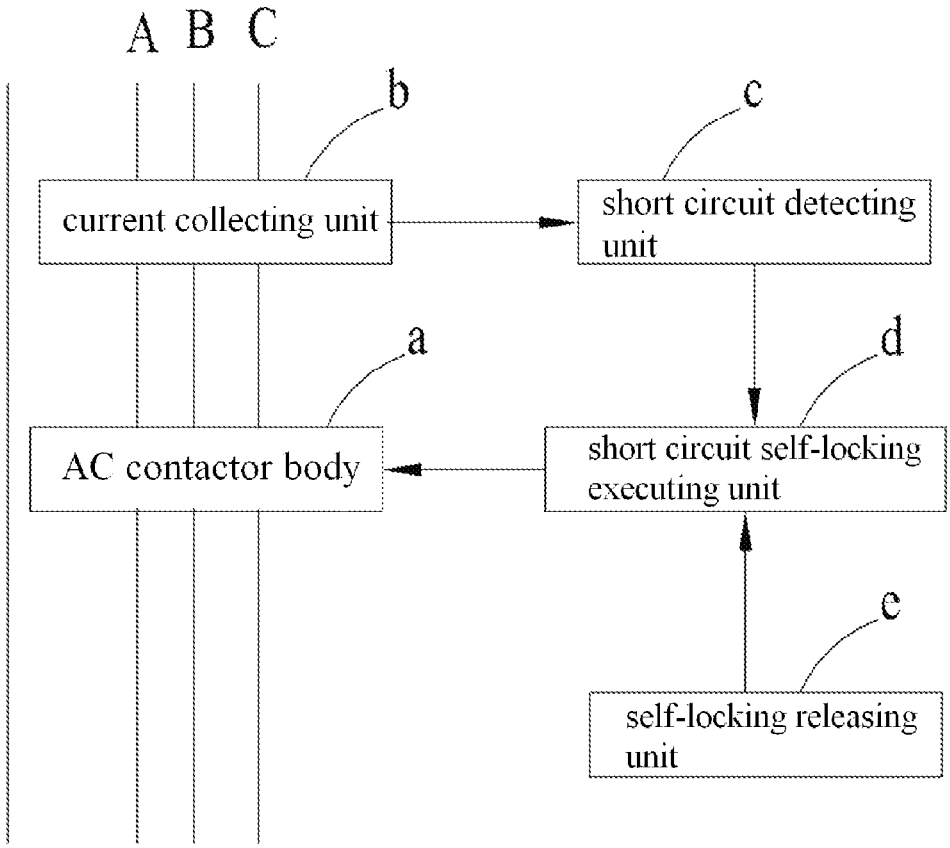
FIG. 1 is a functional and structural block diagram of an AC contactor with an electronic short circuit self-locking function according to a preferred embodiment of the present invention.

Referring to FIG. 1 of the drawings, which is a functional and structural block diagram of an AC contactor with an electronic short circuit self-locking function according to a preferred embodiment of the present invention, the AC contactor with the electronic short circuit self-locking function comprises an AC contactor body.

The AC contactor body a comprises a shell body, and a short circuit self-locking portion is provided inside the shell body, wherein the AC contactor body is for achieving a basic on-off function of the AC contactor.

The short circuit self-locking portion comprises:

a current collecting unit b provided on phase lines A, B and C, for collecting current signals of the phase lines A, B and C where the current collecting unit b is located;

a short circuit detecting unit c connected with the current collecting unit b, for obtaining a voltage signal which characterizes the current signals, comparing with a reference signal, and outputting a short circuit detecting signal when short circuit occurs;

a short circuit self-locking executing unit d for obtaining the short circuit detecting signal to trigger the AC contactor body a to generate and maintain a circuit-breaking action, i.e. maintaining the AC contactor body a in a breaking state; and a self-locking releasing unit e for releasing self-locking of the AC contactor body a and resetting the AC contactor body, wherein the resetting here means that the AC contactor is capable of being closed to achieve current conduction. (Principles are shown in FIG. 2.)

Figure 2:
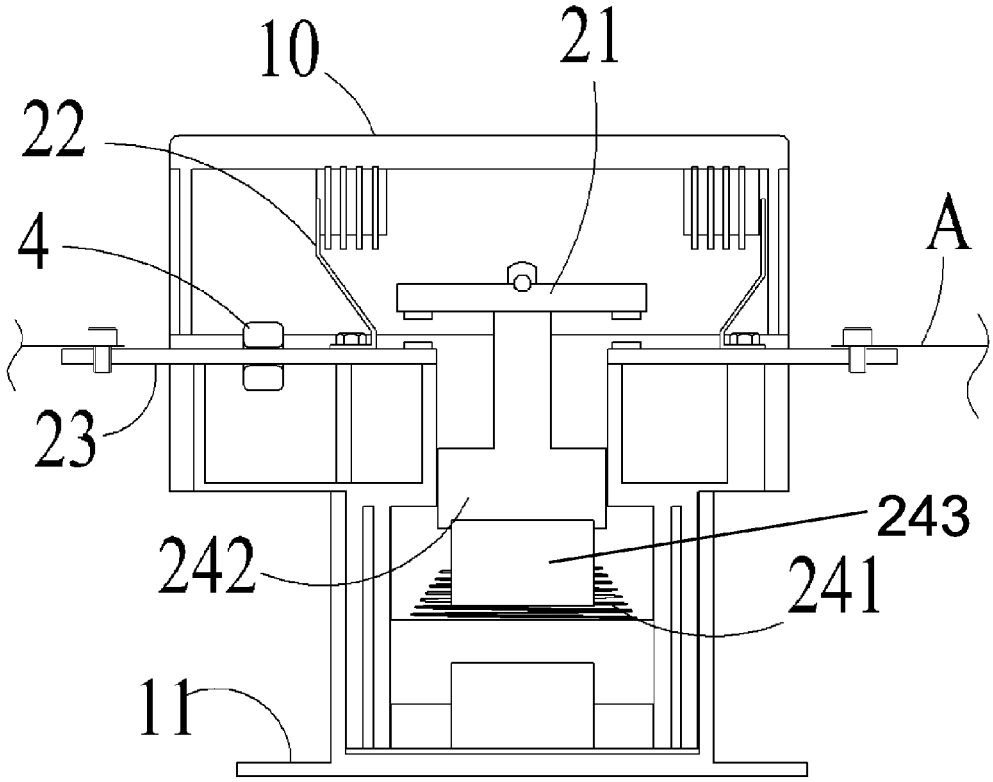
FIG. 2 is an exploded perspective view of the AC contactor with the electronic short circuit self-locking function according to the preferred embodiment of the present invention.
Figure 5:
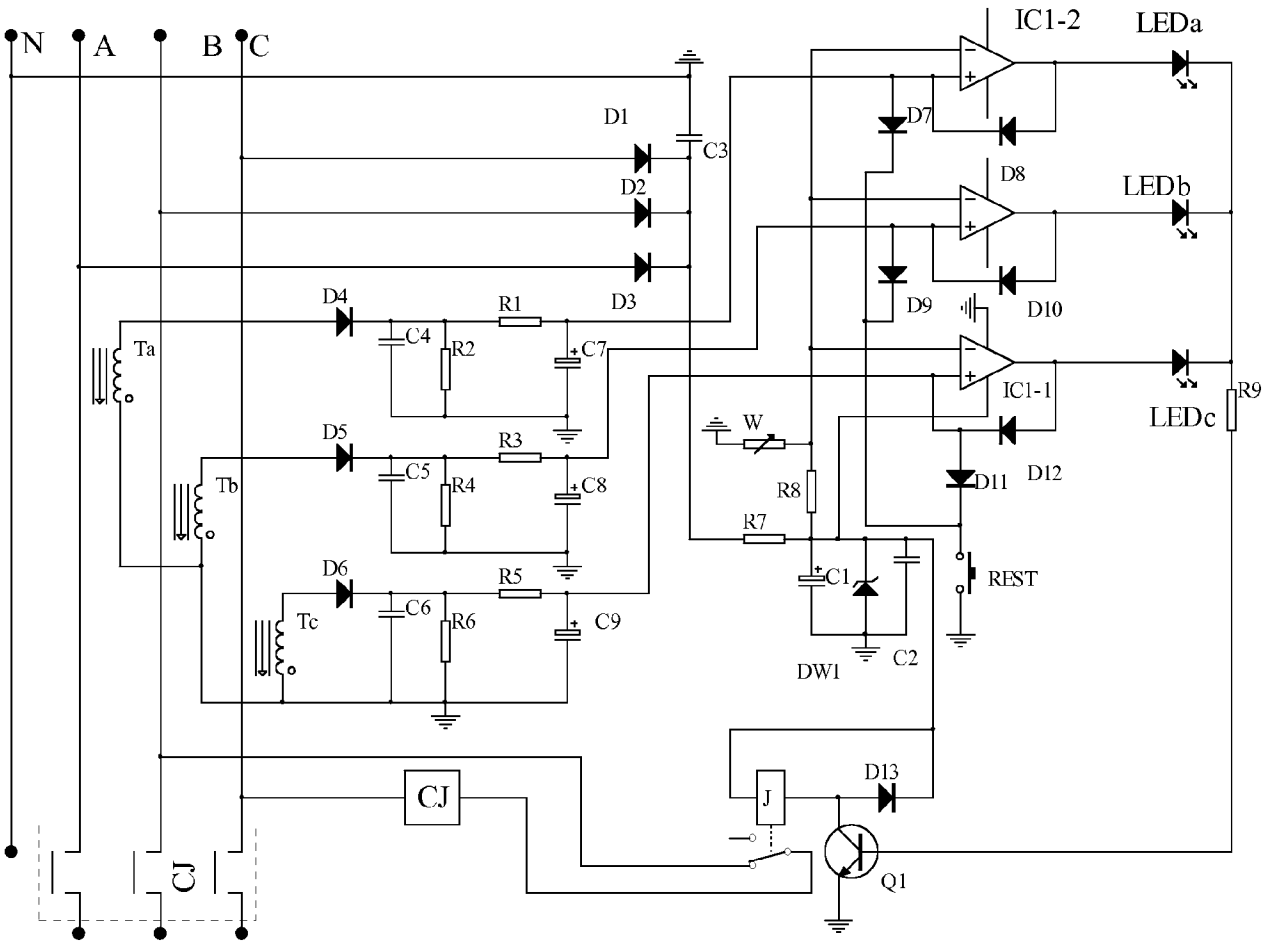
FIG. 5 is a structural circuit diagram of the AC contactor with the electronic short circuit self-locking function according to the preferred embodiment of the present invention.

Referring to FIG. 2 of the drawings, which is an exploded perspective view of the AC contactor with the electronic short circuit self-locking function according to the preferred embodiment of the present invention. A main point of the present invention lies in improving a conventional AC contactor to reach a new security standard. The shell body comprises an upper cover 10 and a lower base 11. An electromagnetic moving unit is provided inside the shell body for generating an electromagnetic action in an electricity conduction state. The electromagnetic moving unit comprises an electromagnet 243, a reset spring 241, a movable iron-core 242 and a control switch (not shown in the drawings), wherein the movable iron-core 242 is connected with the movable contact sheet 21;

the control switch is a normally closed switch, and forms a closed circuit with coils of the electromagnet 243 and a circuit formed by the phase line A (See FIG. 5). That is to say, the electromagnet 243 is capable of attracting the movable iron-core 242 downwardly, so long as a current flows in a circuit that the AC contactor body is located at, in such a manner that the reset spring 241 is in a compression state. When the electromagnet 243 loses magnetic properties, the reset spring 241 resets the movable iron-core 242 upwardly.

Multiple groups of on-off structures are embodied as three groups here. Each group of the on-and off structures is corresponding to one of the phase lines, wherein each on-off structure comprises two static contact sheets and a movable contact sheet 21. The two static contact sheets are respectively connected with an incoming-line metal conducting sheet 23 and an outgoing-line metal conducting sheet in an opposite side. A current transformer 4 which is corresponding to the current collecting unit is provided on the incoming-line metal conducting sheet 23. The incoming-line metal conducting sheet 23 and the outgoing-line metal conducting sheet are respectively connected with the phase line A. A cease spark cover 22 is provided on the incoming-line metal conducting sheet 23, so as to prevent elements or contacts of a circuit from being damaged by arc-light generated by the AC contactor body while switching on/off.

The movable contact sheet 21 is corresponding to the two static contact sheets, and connected with the movable iron-core 242 of the electromagnetic moving unit. In an energized state, the movable iron core 242 drives the movable contact sheet to contact the two static contact sheets, so as to achieve closing a circuit where the movable iron core 242 is located.

Figure 3:
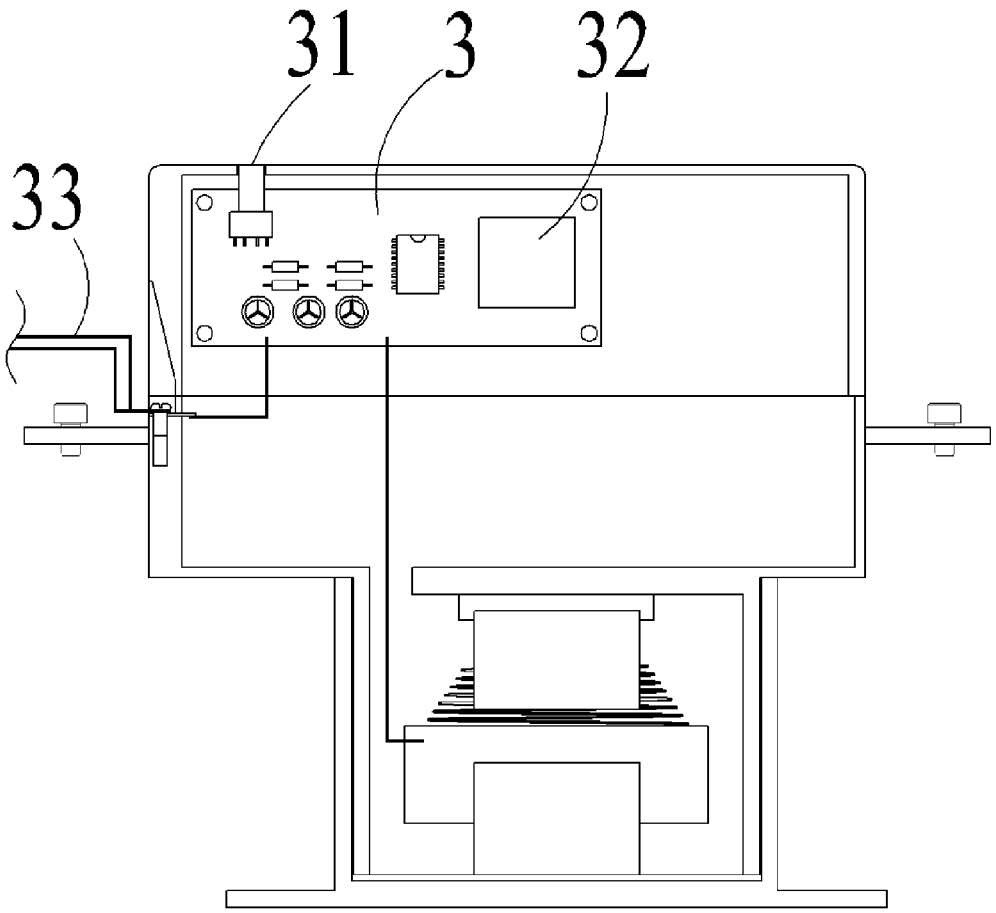
FIG. 3 is a sectional view of the AC contactor with the electronic short circuit self-locking function according to the preferred embodiment of the present invention.
Figure 4:
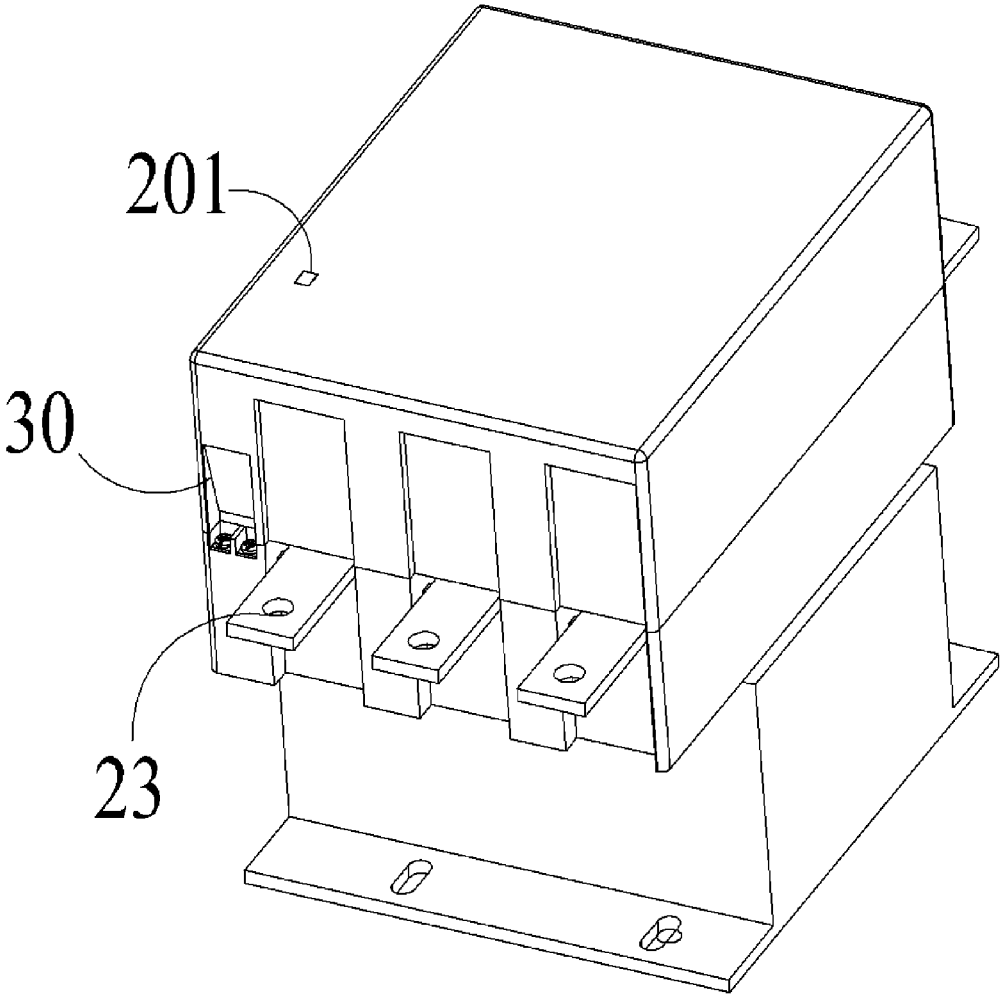
FIG. 4 is a three-dimensional structural view of the AC contactor with the electronic short circuit self-locking function according to the preferred embodiment of the present invention.

Referring to FIG. 3 of the drawings, which is a sectional view of the AC contactor with the electronic short circuit self-locking function according to the preferred embodiment of the present invention, a control circuit board 3 is provided inside the shell body. A relay 32 and a reset switch 31 which is corresponding to the self-locking releasing unit are provided on the control circuit board 3. An external control line 33 is provided on the reset switch 31 and connected with the current transformer 4. A reset hole 201 and an external control line access hole 30 are provided on the shell body (See FIG. 4).

Referring to FIG. 5 of the drawings, FIG. 5 is a structural circuit diagram of the AC contactor with the electronic short circuit self-locking function according to the preferred embodiment of the present invention. The current collecting unit comprises:

current transformers Ta, Tb and Tc (4) each provided on a phase line, wherein since each of the three phase lines A, B and C is required to be detected in the preferred embodiment of the present invention, three current transformers Ta, Tb and Tc (4) are provided here, and a rectifier and filter circuit connected with an output terminal of the current transformers Ta, Tb and Tc (4), so as to process signals output by the current transformers Ta, Tb and Tc (4) to obtain a voltage signal which characterizes the current signals (i.e., current value). The rectifier and filter circuit comprises:

rectifying diodes D4, D5 and D6 which are provided after the corresponding current transformers Ta, Tb and Tc (4);

capacitors C4-C9 for filtering waves; and resistors R1-R6 for dividing voltage.

The preferred embodiment is exemplary only, however collecting manner corresponding to the present invention is not intended to be limiting. Devices capable of collecting current signals of the phase lines A, B and C, and transforming to voltage signals belong to protecting scope of the present invention, e g manganese sheet or copper sheet adopted to replace the current transformers Ta, Tb and Tc (4).

The short circuit detecting unit comprises:

a power circuit which obtains the voltage signal from at least one circuit of the phase lines, processes rectifying, wave-filtering, voltage regulating and voltage dividing, and outputs a power signal, wherein in order to prevent that a power signal is not capable of being supplied due to a fault in one of the phase lines, in the preferred embodiment of the present invention power signals are respectively obtained from the three phase lines A, B and C, wherein the power circuit comprises rectifying diodes D1, D2 and D3 provided corresponding to the phase lines A, B and C, capacitors C1, C2 and C3 for filtering waves, resistors R7 and R8 for dividing voltage, a voltage regulating diode DW1, and an element for regulating a reference value, wherein a voltage dependent resistor W is adopted as the element for regulating the reference value as required, and at least one comparator, wherein an input terminal of the comparator is connected with an output terminal of the rectifier and filter circuit to obtain the voltage signal which characterizes the current signal, a reference terminal of the comparator is connected with the power circuit to obtain the power signal, wherein preferably, a voltage dependent resistor w is adopted to regulate the reference value, and an output terminal of the comparator outputs the short circuit detecting signal when short circuit occurs, i.e., a voltage signal of the input terminal of the comparator is higher than the reference signal, wherein in order to monitor short-circuit faults of each phase line A, B and C, three comparators IC1-1, IC1-2 and IC1-3 are provided.

The short circuit self-locking executing unit comprises:

a trigger element which generates a trigger action after obtaining the short circuit detecting signal, and has a linkage relationship with the control switch, the trigger element triggers the control switch to break when short circuit occurs; wherein the trigger element is embodied as a relay J (32) here, and a plurality of diodes D8, D10 and D12, which are provided between the input terminal of the comparator and the output terminal of the comparator, wherein the diodes and the comparators are equal in amount, the diodes D8, D10 and D12 maintain an output potential thereof when the short circuit detecting signal is generated, so as to achieve a self-locking function, and a conducting reset action is not generated even an external control signal requires to.

The self-locking releasing unit comprises:

a reset switch REST;

diodes D7, D9 and D11 which are connected with the input terminals of the comparator IC1-1, IC1-2 and IC1-3, and connected with a ground terminal via the reset switch REST, and an indicating unit connected with the short circuit detecting unit for receiving the short circuit detecting signal and indicating the phase line which is short circuited.

The indicating unit comprises at least one light-emitting diode provided between the output terminals of the comparators IC1-1, IC1-2 and IC1-3 and the relay J. Three light-emitting diodes LEDa, LEDb and LEDc are provided by the preferred embodiment of the present invention for indicating a short circuit action of each phase line.

One skilled in the art will understand that the embodiment of the present invention as shown in the drawings and described above is exemplary only and not intended to be limiting.

What is claimed is:

1. An alternating current contactor (AC contactor) with electronic short circuit self-locking function, comprising an AC contactor body, wherein said AC contactor body comprises a shell body, and a short circuit self-locking portion is provided inside said shell body, wherein said short circuit self-locking portion comprises:

a current collecting unit for collecting current signals of phase lines;

a short circuit detecting unit for obtaining a voltage signal which characterizes said current signals, comparing with a reference signal, and outputting a short circuit detecting signal when short circuit occurs;

a short circuit self-locking executing unit for obtaining said short circuit detecting signal to trigger said AC contactor body to generate and maintain a circuit-breaking action; and a self-locking releasing unit for releasing self-locking of said AC contactor body and resetting said AC contactor body;

wherein said AC contactor further comprises:

an electromagnetic moving unit, multiple groups of on-off structures, wherein each said group of on-off structures is corresponding to a circuit and comprises:

two static contact sheets respectively connected with one of said phase lines, and a movable contact sheet corresponding to said two static contact sheets and connected with said electromagnetic moving unit, wherein in an energized state, said electromagnetic moving unit drives said movable contact sheet to contact said two static contact sheets, so as to achieve closing the circuit where said electromagnetic moving unit is located.

2. The AC contactor with electronic short circuit self-locking function, as recited in claim 1, wherein said electromagnetic moving unit comprises an electromagnet, a reset spring, a movable iron-core and a control switch, wherein said movable iron-core is connected with said movable contact sheet;

said control switch is a normally closed switch, and forms a closed circuit with coils of said electromagnet and circuits of said phase lines; and when said electromagnet loses magnetic properties, said reset spring resets said movable iron-core, so as to separate said static contact sheets from said movable contact sheet.

3. The AC contactor with electronic short circuit self-locking function, as recited in claim 2, wherein said current collecting unit comprises:

a current transformer provided on at least one of said phase lines, and a rectifier and filter circuit connected with an output terminal of said current transformer, so as to produce a voltage signal which characterizes said current signals.

4. The AC contactor with electronic short circuit self-locking function, as recited in claim 2, wherein said current collecting unit comprises:

a manganese sheet and a copper sheet respectively provided on one of said phase lines, and a rectifier and filter circuit connected with two ends of said manganese sheet and two ends of said copper sheet, so as to produce a voltage signal which characterizes said current signal.

5. The AC contactor with electronic short circuit self-locking function, as recited in claim 4, wherein said short circuit detecting unit comprises:

a power circuit which obtains said voltage signal from at least one circuit of said phase lines, processes rectifying, wave-filtering, voltage regulating and voltage dividing, and outputs a power signal; and at least one comparator, wherein an input terminal of said comparator is connected with an output terminal of said rectifier and filter circuit to obtain said voltage signal which characterizes said current signals, a reference terminal of said comparator is connected with said power circuit to obtain said power signal, and an output terminal of said comparator outputs said short circuit detecting signal.

6. The AC contactor with electronic short circuit self-locking function, as recited in claim 5, wherein said short circuit self-locking executing unit comprises:

a trigger element which generates a trigger action after obtaining said short circuit detecting signal, and has a linkage relationship with said control switch when short circuit occurs, said trigger element triggers said control switch to break; and a diode provided between said input terminal of said comparator and said output terminal of said comparator, for maintaining a potential output when said short circuit detecting signal is generated.

7. The AC contactor with electronic short circuit self-locking function, as recited in claim 5, wherein said self-locking releasing unit comprises:

a reset switch; and a diode connected with said input terminal of said comparator, which is connected with a ground terminal via said reset switch.

8. The AC contactor with electronic short circuit self-locking function, as recited in claim 7, wherein said AC contactor with electronic short circuit self-locking function further comprises an indicating unit connected with said short circuit detecting unit for receiving said short circuit detecting signal and indicating a phase line which is short-circuited.

9. The AC contactor with electronic short circuit self-locking function, as recited in claim 8, wherein said indicating unit comprises at least one light-emitting diode provided between said output terminal of said comparator and said trigger element.

10. The AC contactor with electronic short circuit self-locking function, as recited in claim 9, wherein said trigger element is a relay.

11. The AC contactor with electronic short circuit self-locking function, as recited in claim 3, wherein said short circuit detecting unit comprises:

a power circuit which obtains said voltage signal from at least one circuit of said phase lines, processes rectifying, wave-filtering, voltage regulating and voltage dividing, and outputs a power signal; and at least one comparator, wherein an input terminal of said comparator is connected with an output terminal of said rectifier and filter circuit to obtain said voltage signal which characterizes said current signals, a reference terminal of said comparator is connected with said power circuit to obtain said power signal, and an output terminal of said comparator outputs said short circuit detecting signal.

12. The AC contactor with electronic short circuit self-locking function, as recited in claim 11, wherein said short circuit self-locking executing unit comprises:

a trigger element which generates a trigger action after obtaining said short circuit detecting signal, and has a linkage relationship with said control switch when short circuit occurs, said trigger element triggers said control switch to break; and a diode provided between said input terminal of said comparator and said output terminal of said comparator, for maintaining a potential output when said short circuit detecting signal is generated.

13. The AC contactor with electronic short circuit self-locking function, as recited in claim 11, wherein said self-locking releasing unit comprises:

a reset switch; and a diode connected with said input terminal of said comparator, which is connected with a ground terminal via said reset switch.

14. The AC contactor with electronic short circuit self-locking function, as recited in claim 13, wherein said AC contactor with electronic short circuit self-locking function further comprises an indicating unit connected with said short circuit detecting unit for receiving said short circuit detecting signal and indicating a phase line which is short-circuited.

15. The AC contactor with electronic short circuit self-locking function, as recited in claim 14, wherein said indicating unit comprises at least one light-emitting diode provided between said output terminal of said comparator and said trigger element.

16. The AC contactor with electronic short circuit self-locking function, as recited in claim 15, wherein said trigger element is a relay.

* * * * *